US006849330B1

(12) United States Patent
Morin et al.

(10) Patent No.: US 6,849,330 B1
(45) Date of Patent: Feb. 1, 2005

(54) THERMOPLASTIC FIBERS EXHIBITING DURABLE HIGH COLOR STRENGTH CHARACTERISTICS

(75) Inventors: Brian Morin, Moore, SC (US); Martin Cowan, Greer, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 10/651,777

(22) Filed: Aug. 30, 2003

(51) Int. Cl.[7] ..... D01F 6/00; C08J 0/00; C08L 0/00

(52) U.S. Cl. ..... 428/364; 428/372; 428/394; 524/242; 524/387

(58) Field of Search ..... 524/242, 387; 552/259; 428/364, 395, 372, 394

(56) References Cited

U.S. PATENT DOCUMENTS

| | | | |
|---|---|---|---|
| 4,016,118 A | 4/1977 | Hamada et al. | 524/108 |
| 4,116,626 A | 9/1978 | Varner | 4/149 |
| 4,132,817 A | 1/1979 | Tillotson | 427/244 |
| 4,171,395 A | 10/1979 | Tollotson | 428/95 |
| 4,463,113 A | 7/1984 | NaKahara et al. | 524/117 |
| 4,512,831 A | 4/1985 | Tillotson | 156/78 |
| 4,522,857 A | 6/1985 | Higgins | 428/95 |
| 4,560,734 A | 12/1985 | Fujishita et al. | 526/142 |
| 5,049,605 A | 9/1991 | Rekers | 524/108 |
| 5,136,520 A | 8/1992 | Cox | 364/470 |
| 5,208,592 A | 5/1993 | Johnson, Jr. | 341/63 |
| 5,231,126 A | 7/1993 | Shi et al. | 524/296 |
| 5,342,868 A | 8/1994 | Kimura et al. | 524/108 |
| 5,512,357 A | 4/1996 | Shimura et al. | 428/283 |
| 5,540,968 A | 7/1996 | Higgins | 428/95 |
| 5,545,276 A | 8/1996 | Higgins | 156/79 |
| 5,753,736 A | 5/1998 | Bhat | 524/287 |
| 5,798,167 A | 8/1998 | Connor et al. | 428/171 |
| 5,811,045 A | 9/1998 | Pike | 264/168 |
| 5,912,292 A | 6/1999 | Sun | 524/301 |
| 5,945,215 A | 8/1999 | Bersted et al. | 428/364 |

(List continued on next page.)

FOREIGN PATENT DOCUMENTS

| | | |
|---|---|---|
| EP | 0 611 271 | 2/1994 |
| EP | 0 806 237 | 5/1997 |
| JP | 11061554 A | 3/1999 |
| JP | 11140719 | 5/1999 |
| JP | P2002-302825 | 4/2001 |
| WO | 02/46502 | 6/2002 |

OTHER PUBLICATIONS

Patent abstracts of Japan; publication No. 11–061554; date of publication of application Mar. 5, 1999; Highly heat–resistant polypropylene fiber; English translation.

(List continued on next page.)

*Primary Examiner*—N. Edwards
(74) *Attorney, Agent, or Firm*—Terry T. Moyer; John E. Vick, Jr.

(57) ABSTRACT

Improvements in permitting brighter colorations within polypropylene fibers and/or yarns while simultaneously providing more efficient production methods of manufacturing of such colored fibers as well are provided. Generally, such fibers and/or yarns have been colored with pigments, which exhibit dulled results, or dyes, which exhibit high degrees of extraction and low levels of lightfastness. Such dull appearances, high extraction levels, and less than stellar lightfastness properties negatively impact the provision of such desirable colored polypropylene fibers and/or yarns which, in turn, prevents the widespread utilization of such fibers and yarns in various end-use applications. Thus, it has surprisingly been determined that brighter colorations, excellent extraction, and more-than-acceptable lightfastness characteristics can be provided, preferably, through manufacture with certain polymeric colorants that include poly (oxyalkylene) groups thereon. Fabric articles comprising such novel fibers and/or yarns are also encompassed within this invention.

51 Claims, 5 Drawing Sheets

U.S. PATENT DOCUMENTS

| | | | | |
|---|---|---|---|---|
| 5,948,500 | A | 9/1999 | Higgins | 428/95 |
| 6,102,999 | A | 8/2000 | Cobb, III et al. | 106/243 |
| 6,110,588 | A | 8/2000 | Perez et al. | 428/359 |
| 6,127,440 | A | 10/2000 | Sanyasi | 521/74 |
| 6,127,470 | A | 10/2000 | Cobb, III et al. | 524/367 |
| 6,135,987 | A | 10/2000 | Tsai et al. | 604/365 |
| 6,162,887 | A | 12/2000 | Yamada et al. | 526/351 |
| 6,203,881 | B1 | 3/2001 | Higgins | 428/95 |
| 6,207,600 | B1 | 3/2001 | Nakajima et al. | 442/311 |
| 6,210,802 | B1 | 4/2001 | Risch et al. | 428/398 |
| 6,218,011 | B1 | 4/2001 | Raetzsch et al. | 428/394 |
| 6,231,976 | B1 | 5/2001 | Dean et al. | 428/373 |
| 6,238,615 | B1 | 5/2001 | Kobayashi et al. | 264/537 |
| 6,261,677 | B1 | 7/2001 | Tsai et al. | 428/221 |
| 6,270,608 | B1 | 8/2001 | Vair, Jr. et al. | 156/176 |
| 6,284,370 | B1 | 9/2001 | Fujimoto et al. | 428/221 |
| 6,300,415 | B1 | 10/2001 | Okayama et al. | 525/191 |
| 6,358,450 | B1 | 3/2002 | Sun | 264/178 |
| 6,420,024 | B1 | 7/2002 | Perez et al. | 428/359 |
| 6,468,623 | B1 | 10/2002 | Higgins | 428/95 |
| 6,528,564 | B1 * | 3/2003 | Xia | 524/242 |
| 6,534,574 | B1 | 3/2003 | Zhao et al. | 524/284 |
| 6,541,554 | B2 * | 4/2003 | Morin et al. | 524/387 |
| 6,559,211 | B2 | 5/2003 | Zhao et al. | 524/285 |
| 6,559,216 | B1 | 5/2003 | Zhao et al. | 524/336 |
| 6,593,483 | B2 * | 7/2003 | Xia | 552/259 |
| 6,656,404 | B2 | 12/2003 | Morin et al. | 264/210.5 |
| 2001/0040320 | A1 | 11/2001 | Kobayashi et al. | 264/537 |
| 2001/0048179 | A1 | 12/2001 | Stewart et al. | 264/211 |
| 2002/0002241 | A1 | 1/2002 | Raetzsch et al. | 123/556 |

OTHER PUBLICATIONS

Patent abstracts of Japan; publication No. 11–181619; date of publication of application Jul. 6, 1999; Highly heat–resistant polypropylene fiber and fiber–reinforced cement molded product using the same; English translation.

Patent abstracts of Japan; publication No. 2001–081628; date of publication Mar. 27, 2001; Flat yarn for base cloth of needle–pouched carpel; English translation.

Patent abstracts of Japan; publication No. 2002–302825; date of publication Oct. 18, 2002; Hihgly–resistant polypropylene fiers; English translation.

Article; Journal of applied polymer science, vol. 62, 1965–1975 (1996) John Wiley & Sons, Inc.; Spruiell et al.

Article; The effects of pigments on the development of structure and properties of polypropylene filaments: Antec '91; Lin et al.

Article; The role of crystallization kinetics in the development of the structure and properties of polypropylene filaments; © 1993 John Wiley & Sons, Inc.; CCC 0021–8995/93/040623–9.

Article; Study on the formation of b–crystalline form isotactic polypropylene fiber; fiber and films, Intern, Polymer Processing VI, 1991; Chen et al.

Article: Heterogeneous Nucleation of Polypropylene and Polpropylene Fibers; Marcincin et al.; 1994.

* cited by examiner

THERMOPLASTIC FIBERS EXHIBITING DURABLE HIGH COLOR STRENGTH CHARACTERISTICS

FIELD OF THE INVENTION

This invention relates to improvements in permitting brighter colorations within thermoplastic fibers and/or yarns while simultaneously providing more efficient production methods of manufacturing of such colored fibers as well. Generally, such fibers and/or yarns have been colored with pigments, which exhibit dulled results, or dyes, which exhibit high degrees of extraction and low levels of lightfastness. Such dull appearances, high extraction levels, and less than stellar lightfastness properties negatively impact the provision of such desirable colored thermoplastic (such as, without limitation, polypropylene) fibers and/or yarns which, in turn, prevents the widespread utilization of such fibers and yarns in various end-use applications. Thus, it has surprisingly been determined that brighter colorations, excellent extraction, and more-than-acceptable lightfastness characteristics can be provided through manufacture with certain polymeric colorants that include poly(oxyalklene) groups thereon. Fabric articles comprising such novel thermoplastic fibers and/or yarns are also encompassed within this invention.

DISCUSSION OF THE PRIOR ART

All U.S. patents cited below are herein entirely incorporated by reference.

Thermoplastic fibers have been utilized many years for myriad different fabric and textile applications. In particular, polyolefin, polyester, and polyamide fibers have been prominent as replacements for naturally occurring fibers (such as cotton and wool, for instance) due to lower costs, more reliability in supply, physical properties, and other like benefits. Colorations have been available for such thermoplastic, synthetic fibers in order to provide aesthetic, identification, and other properties. Such colorations have been mostly provided through pigments that thoroughly color the target fibers and exhibit sufficiently high lightfastness and crocking characteristics that use thereof has not been curtailed. Dyeing within baths is available for already-formed fabrics (such as knit, woven, and/or non-woven textiles), if a solid color is desired, and also for yarns with selected properties through package dyeing procedures. However, accent yarns or other fibers that require individual colorations requires coloring during production. In addition, some polymers such as polypropylene, polyethylene, etc., have not been heretofore able to accept dyes of any kind, and have thus been colored with pigment. Thus, although such pigment colorants are prevalent and generally effective at providing color within such thermoplastic fibers, there are certain drawbacks for which improvements have been unavailable. For example, pigments are notoriously capable of staining fiber manufacturing/extrusion machinery such that control of discolorations within subsequently produced fibers is rather difficult, and the time required to change colors is high. Also, pigments impart a dulling appearance, a lack of brightness, and a low luster, all believed to be due to the solid nature of such coloring agents. In addition, pigment size and dispersion limits the processability of small fibers, which are desirable for their improved touch and feel. Thus, improvements in such areas are desirable for coloring agents to be introduced within thermoplastic fibers.

In particular, it has been found that improvements in coloring individual polyolefin fibers are needed. For instance, there has been a continued desire to utilize low denier polypropylene fibers in various different products, such as apparel (due to highly effective soft hand properties), and the like. Polyolefin fibers exhibit excellent strength characteristics, highly desirable hand and feel, and do not easily degrade or erode when exposed to certain "destructive" chemicals. However, even with such impressive and beneficial properties and an abundance of polyolefin (such as polypropylene, polyethylene, and the like), which is relatively inexpensive to manufacture and readily available as a petroleum refinery byproduct, such fibers are not widely utilized in products that require fiber and/or yarn colorations therein. Specifically, although polyesters (such as polyethylene terephthalate, or PET) and polyamides (such as nylons) are generally more expensive to manufacture, such fibers do not exhibit the same unacceptable color disadvantages inherent within polyolefins. This is due in large part to the difficulties inherent in providing sufficiently bright colorations within such target polyolefin fibers and/or yarns in general. Thus, it is imperative to provide remedies to such issues to permit utilization of such lower cost polymer materials in greater varieties of end-uses.

Pigments, the most prevalent of polyolefin fiber colorants utilized throughout the fabric industry, as noted above, are, as is well-known, solid particles that require a relatively high amount to provide sufficiently deep colorations within such target materials. Because such pigments exhibit colorations within the discrete areas in which they are actually present, complete pigment presence is required to fully color such target fibers and/or yarns. If certain discrete areas of such target materials do not include any or insufficient amounts of pigments, streaks, uneven colorations, and other aesthetically displeasing results will most likely result. Hence, proper color provision via pigment presence within polyolefin fibers and/or yarns requires large amounts of such solid particles to accord the needed level of colorations therein. However, with such a large amount of pigment present within such target fibers and/or yarns comes an inevitable dull appearance as well. Without intending to be limited to any specific scientific theory, it has now been hypothesized by the inventors that such a dull appearance is attributable to the lack of transparency through the target fiber and/or yarn within which such pigments are added. The solid nature of such pigment particles basically appears to fill the entire fiber and/or yarn to the extent that light cannot pass through easily. Thus, the visible color provided by the fiber and/or yarn is limited to that portion of the scattered light that is reflected back to the viewer alone. As such, the color appears dull to the eye thereby compromising the resultant brightness effect of the fiber, and the ultimate fabric within which such a fiber is incorporated. Thus, there exists the need to provide a distinct improvement on dullness (brightness) in this type of situation in order to permit utilization of more brightly colored polyolefin fibers and/or yarns in order to permit, in turn, more aesthetically pleasing fabric articles from a coloration perspective. Furthermore, and just as important, such pigments are extremely difficult to purge from within manufacturing machinery, particularly within fiber extrusion units, such that once a new color is desired for target fiber materials, extensive purging is required for proper cleaning. Such cleaning is generally quite extensive and complicated since a small amount of residual pigment anywhere within the machinery can discolor any amount of extruded fiber therein. Thus, utilization of either potentially harmful solvents, in-depth and invasive cleaning procedures throughout the entire unit, and/or wasteful flushing processes that also potentially result in pigment effluent production within wastewater, and the norm rather than the exception for pigment-colored polypropylene methods.

Dyes have also been utilized to color not only polyolefin fibers and/or yarns, but also materials such as nylon, polyesters, cotton, and other fiber types. As noted above, in general, polyolefins are an economically superior fiber as compared with other synthetic types (polyesters, nylons, for example); however, its widespread use has been limited due to such issues as this coloration problem. Thus, although dyes have provided bright colorations in these other types of fibers, extraction and lightfastness issues have, again, severely limited utilization of such coloring agents within polyolefins. In essence, such soluble coloring agents do not react readily within polyolefin without exhibiting migration and extraction over time. Polyesters and nylons, as examples, include reactive groups that permit reaction therein with dyes (sulfonated types, for example) and which in turn do not exhibit appreciable extraction as a result. Within polyolefins, to the contrary, extraction levels are quite high for such dyes and thus unevenness in color, streaking, if not complete loss in color, are typical results. This problem is further amplified when fabrics made therefrom such dyed polyolefins are subjected to laundering treatments. Lightfastness (the ability of the target fibers and/or yarns to retain their desired color levels, if not colors at all) are generally unacceptable as well when dyes are utilized without having excessive amounts of protecting agents (UV absorbers, for example) added in addition. Furthermore, the same machinery staining issues and potential wastewater problems are present with dyes as well, albeit to a lesser degree because of the liquid nature of such coloring agents. In any event, a certain degree of difficulty still exists within liquid dye processing within polyolefin fiber and/or yarn manufacturing (extruding, for example) due to such staining characteristics. Thus, as for pigments above, efficiency is compromised during fiber manufacture such that any cost benefits of utilizing polyolefin as compared with other synthetic fiber and/or yarn types are reduced to a level that is unacceptable for displacement within the fabric industry.

In addition, with pigment coloring of fibers, the pigments are normally matched to a standard shade in a high concentration masterbatch that is then diluted with uncolored polymer during the fiber manufacture. As such, if there is a problem or mismatch between the color masterbatch, there is only limited adjustment available at the fiber manufacturing stage. This often necessitates re-manufacture of the masterbatch, adding expense and delaying the manufacturing process.

All in all, it is evident that polyolefin has suffered from coloring limitations in the past such that displacement of more expensive fiber types has not been forthcoming and that the standard coloring agents utilized today have neither imparted the necessary brightness, extraction levels, lightfastness properties, and low staining characteristics that appear to be the main obstacles to more widespread use of colored polypropylene fibers within the fabric industry. To date, there simply has not been any coloring agent that has accorded necessary bright colorations, excellent low (if not nonexistent) extraction levels, and superior lightfastness results within the polypropylene fiber and/or yarn industry.

DESCRIPTION OF THE INVENTION

It is thus an object of the invention to provide thermoplastic (such as polypropylene, as one non-limiting example) fibers and/or yarns that exhibit extremely bright and aesthetically pleasing colorations as compared to pigmented products. A further object of the invention is to provide such colorations that are of very low, if nonexistent, extraction. A further object of the invention is to provide a specific method for the production of brightly colored thermoplastic fibers that permits quick and efficient changeover from one colorant to another. Additionally, another object of this invention is to provide a brightly colored thermoplastic fiber and/or yarn that exhibits outstanding lightfastness properties, either alone or in the presence of minimal amounts of UV absorber additives. Another object of the invention is to provide a process for manufacturing fibers using liquid colors in which the shade can be adjusted to match some standard.

Accordingly, this invention encompasses a colored thermoplastic fiber compromising a liquid colorant present therein in a rod-like configuration. Furthermore, this invention encompasses a colored thermoplastic fiber including at least one liquid colorant therein, wherein said at least one liquid colorant therein exhibits a very low extraction and crocking level therefrom. Additionally, this invention encompasses a method of producing a colored thermoplastic fiber including the steps of a) providing a molten thermoplastic formulation, optionally including colored thermoplastic concentrates therein, wherein said concentrates comprise at least one liquid polymeric colorant; and b) extruding said thermoplastic formulation of step "a" within a fiber extrusion line to form a colored thermoplastic fiber, wherein, optionally at least one liquid polymeric colorant is simultaneously injected within said fiber extrusion line during extrusion of said thermoplastic formulation of step "a"; and. Optionally, this process has the additional steps of providing multiple liquid color constituents in step "a" or "b", matching the resulting fibers to a standard, and adjusting the ratio of the multiple liquid color constituents so provided to adjust the color of the resulting fiber to match the standard. This invention also encompasses the formation of a colored film including such liquid polymeric colorants, and the formation of colored tape fibers therefrom.

As used herein, the term "thermoplastic" is intended to mean a polymeric material that will melt upon exposure to sufficient heat but will retain its solidified state, but not prior shape without use of a mold or like article, upon sufficient cooling. Specifically, as well, such a term is intended solely to encompass polymers meeting such a broad definition that also exhibit either crystalline or semi-crystalline morphology upon cooling after melt-formation through the use of the aforementioned mold or like article. For this invention, however, the thermoplastic is to be utilized to from fibers and/or yarns through any number of techniques, including, without limitation, extrusion (for multifilament and monofilament types), spinning, water- and/or air-quenching, spun-bonded and/or melt-blown non-woven products, staple fibers, bicomponent/splittalbe fibers, tape and/or ribbon fibers (through slit film procedures, as one example), and the like. Particular types of polymers contemplated within such a definition include, without limitation, polyolefins (such as polyethylene, polypropylene, polybutylene, and any combination thereof), polyamides (such as nylon), polyurethanes, polyesters (such as polyethylene terephthalate), polylactic acids, and any copolymers of these broad types, either within the same classification or not. Polypropylene fibers are most preferred, although polyesters are preferred as well. The particular polypropylene fiber and/or yarn of this invention may be of any denier, including microdeniers (below about 1.5 denier per fiber) or higher deniers 1.5 denier per fiber or higher), as merely examples.

The target fibers and/or yarns may also be textured in any manner commonly followed for polypropylene materials. One example of this is false-twist texturing, in which a twist is imparted to the fiber through the use of spindles, and while the fiber is in the twisted state it is heated and then cooled to impart into the individual filaments a memory of the twisted state. The yarn is then untwisted, but retains bulk due to the imparted memory. In another texturing embodiment, known as bulked continuous filament (BCF), the yarn is pushed with air jets into a stuffer box where it is crowded in a non-uniform state with other fibers and heated to retain the memory of this non-uniform state. The yarn is then cooled, but again retains bulk due to the imparted memory. Of course, other texturing methods, such as air texturing, gear texturing, and the like, may be used.

The term "polypropylene" is intended to encompass any polymeric composition comprising propylene monomers, either alone or in mixture or copolymer with other randomly selected and oriented polyolefins, dienes, or other monomers (such as ethylene, butylene, and the like). Such a term also encompasses any different configuration and arrangement of the constituent monomers (such as syndiotactic, isotactic, and the like). Thus, the term as applied to fibers is intended to encompass actual long strands, tapes, threads, and the like, of drawn polymer. The polypropylene may be of any standard melt flow (by testing); however, standard fiber grade polypropylene resins possess ranges of Melt Flow Indices between about 1 and 1000.

Contrary to standard manufacturing procedures and techniques for plaques, containers, sheets, and the like (such as taught within U.S. Pat. No. 4,016,118 to Hamada et al., for example), fibers clearly differ in structure since they must exhibit a length that far exceeds its cross-sectional area (such, for example, its diameter for round fibers). Fibers are extruded and drawn; articles are blow-molded or injection molded, to name two alternative production methods. Also, the crystalline morphology of polypropylene within fibers is different than that of standard articles, plaques, sheets, and the like. For instance, the dpf of such polypropylene fibers is at most about 5000; whereas the dpf of these other articles is much greater. Polypropylene articles generally exhibit spherulitic crystals while fibers exhibit elongated, extended crystal structures. Thus, there is a great difference in structure between fibers and polypropylene articles such that any predictions made for spherulitic particles (crystals) of colored polypropylene articles do not provide any basis for determining the effectiveness of coloring agents as additives within polypropylene fibers. For instance, plaques made with pigments can exhibit bright, deep shades, and still appear transparent in fiber form, dullness (low brightness) and opacity are prominent when deep shades of pigmented fibers are produced. Thus, the significant differences in form and structure between sheet-like articles and fibers (and/or yarns) of the same thermoplastic, make it difficult to predict how effective a specific coloring agent may perform within one through knowledge of the other.

The coloring agents particularly useful within this invention are those that are liquid in nature, preferably, though not necessarily, polymeric in nature [i.e., poly(oxyalkylenated)] to the extent that, upon introduction within such target polypropylene fibers, extraction therefrom is severely limited, if not nonexistent. The term "liquid" is intended to mean that such colorants are liquid at room temperature and standard pressure (25° C. at 1 atmosphere). Example colorants that meet these limitations (and thus are defined by the term "liquid polymeric colorants" herein) are those that are available from Milliken & Company under the tradename CLEARTINT®. Alternatively, liquid dyestuffs may also be utilized, although less preferred than polymeric types.

The preferred colorants in this general class are represented by the following formula (1):

$$R\{A[(B)_n]_m\}_x \qquad (I)$$

wherein

R is an organic chromophore;

A is a linking moiety in said chromophore selected from the group consisting of N, O, S, $SO_2N$, and $CO_2$;

B is an alkyleneoxy constituent contains from 2 to 4 carbon atoms;

n is an integer of from 2 to about 500;

m is 1 when A is O, S, or $CO_2$, and m is 2 when A is N or $SO_2N$; and x is an integer of from 1 to about 5.

The molecular weight of such colorants are at least 2000 and, due to the high oxyalkylenation present, are highly water soluble and liquid at room temperature. The organic chromophore is, more specifically, one or more of the following types of compounds: azo, diazo, disazo, trisazo, diphenylmethane, triphenylmethane, xanthene, nitro, nitroso, acridine, methine, styryl, indamine, thiazole, oxazine, stilbene, or anthraquinone. In an alternative embodiment, the chromophore may be optically inactive, at least within the visible spectrum, but absorb uv radiation, as one example, thereby imparting ultraviolet protection to the target fibers. Preferably, R is one or more of azo, diazo, triphenylmethane, methine, anthraquinone, or thiazole based compounds. Such a group may produce coloring effects that are evident to the eye; however, optical brightening chromophores are also contemplated in this respect. Group A is present on group R and is utilized to attach the polyoxyalkylene constituent to the organic chromophore. Nitrogen is the preferred linking moiety. The polyoxyalkylene group is generally a combination of ethylene oxide and propylene oxide monomers. Preferably propylene oxide is present in the major amount, and most preferably the entire polyoxyalkylene constituent is propylene oxide.

The preferred number of moles (n) of polyoxyalkylene constituent per polyoxyalkylene chain is from 2 to 50, more preferably from 10 to 30. Also, preferably two such polymeric chains are present on each polymeric colorant compound (x, above, is preferably 2). In actuality, the number of moles (n) per polymeric chain is an average of the total number present since it is very difficult to control the addition of specific numbers of moles of alkyleneoxy groups. The Table below lists the particularly preferred colorants (with the range of alkoxylation present on the colorant listed due to the inexactness of production of specific chain lengths) for utilization in relation to Structure (I), above:

COLORANT TABLE
Preferred Poly(oxyalkylenated) Colorants

| Col. # | R | A | B(with moles) | m | x | Color |
|---|---|---|---|---|---|---|
| 1 | Methine | N | 6-8 EO; 12-15 PO | 2 | 1 | Yellow |
| 2 | Benzothiazole diazo | N | 6-8 EO; 10-12 PO | 2 | 1 | Red |
| 3 | Triphenylmethane | N | 2-4 EO; 12-15 PO | 2 | 2 | Cyan |
| 4 | Aminothiophene Diazo | N | 0-12 EO; 12-15 PO | 2 | 1 | Violet |
| 5 | Phenyl Diazo | N | 8-10 EO; 10-12 PO | 2 | 2 | Orange |

Such colorants provide the aforementioned, highly desirable, low extraction properties, as well as the significant bright colorations as compared with pigmented fibers.

Without intending on being limited to any specific scientific theory, it appears that such colorants are capable of complete introduction within the target polypropylene fibers to the extent that transparent thin rod-like configurations of the liquid colorants are present within the fibers after extrusion. Such configurations thus permit an even distribution of color throughout the target fiber, and, apparently, with a strong cohesive nature while present therein said fibers, such thin rod-like configurations are not amenable to easy migration from therein either. In other words, although small openings may exist within and/or at the surface of such extruded polypropylene fibers, the rod-like configurations of the colorants therein do not break, but appear to keep there rod-like appearance and the liquid colorant thus does not migrate or escape through such surface openings, even if such fibers come into contact with adhesive surfaces themselves. Such a physical appearance is shown within the drawings discussed below. In essence, empirically the liquid colorants (polymerics, preferably, although possible liquid dyestuffs may function similarly) will appear as long strands of color within extruded fibers if the methods of producing disclosed herein are employed when viewed at proper magnifications (such as from 300 to 1000×; proper viewing may be seen most readily between 500 and 600×). Cross-sectionally, such long strands will appear as small dots within the target fibers. These dots will be the tops of these rod-like structures which can then be noticed from side views as the aforementioned strands. Thus, since these strands are basically pools of liquid color stretched during the fiber extrusion process, these structures will exhibit aspect ratios (length to diameter) of from 10:1 to 500,000:1, preferably from 50:1 to 100,000:1, more preferably from 50:1 to 10,000:1, and most preferably from 100:1 to 1,000:1. Thus, the term rod-like is intended to encompass these high aspect ratio strands of liquid color within target thermoplastic fibers. Since the thermoplastic will be colorless, or at least sufficiently different in color from the added liquid coloring agent, it is relatively easy to view such rod-like structures through side views coupled with cross-sectional views. Again, the continuous strands of color or easily viewed from the side; the "dots" of tops of different strands are easily viewed in cross-section.

This rod-like configuration also provides effective and even colorations throughout such target fibers because of the ability of light to pass through such fibers and transparent film-like structures simultaneously. Thus, light is transmitted through such fibers as well as absorbed by the colorants therein due to the transparent appearance of the resultant fiber. The resultant appearance is, unexpectedly, very bright in nature, much more so, for example, than the empirical appearance of the above discussed pigmented fibers that require a large amount of solid particles therein to provide even colorations throughout, but which, as a result, also exhibit very dull appearances as well. The colored transparent nature available with these inventive liquid colorants produces the bright colorations, much like a colored filter placed over a light imparts a bright, colored effect when the light shines therethrough. The fibers themselves are generally solid in nature, and, cross-sectionally, appear as round, triangular, square, and/or rectangular in shape, but may have any cross sectional shape, such as octalobal which is popular in carpet fibers.

Such fibers (or yarns comprising such fibers) may also include the presence of certain compounds that quickly and effectively provide rigidity and/or tensile strength to the target polypropylene fiber to a level heretofore unavailable, particularly in terms of permitting high-speed spinning for greater efficiency in fiber and/or yarn manufacturing. Generally, these compounds include any structure that nucleates polymer crystals within the target polypropylene after exposure to sufficient heat to melt the initial pelletized polymer and upon allowing such a melt to cool. The compounds must nucleate polymer crystals at a higher temperature than the target polypropylene without the nucleating agent during cooling. In such a manner, the nucleator compounds provide nucleation sites for polypropylene crystal growth which, in turn, appear to provide thick lamellae within the fibers themselves which, apparently (without intending on being bound to any specific scientific theory) increase the processability of the target fibers to such a degree that the tensions associated with high-speed spinning can easily be withstood. The preferred nucleating compounds include dibenzylidene sorbitol based compounds, as well as less preferred compounds, such as sodium benzoate, certain sodium and lithium phosphate salts (such as sodium 2,2'-methylene-bis-(4,6-di-tert-butylphenyl)phosphate, otherwise known as NA-11 or NA-21), zinc glycerolate, and others. Sodium benzoate, in general, is not preferred because it is known to outgas corrosive benzoic acid, among other deficiencies. Also, the amount of nucleating agent present within the inventive fiber is at least 10 ppm; preferably this amount is at least 100 ppm; and most preferably is at least 1250 ppm. Any amount of such a nucleating agent should suffice to provide the desired shrinkage rates after heat-setting of the fiber itself; however, excessive amounts (e.g., above about 10,000 ppm and even as low as about 6,000 ppm) should be avoided, primarily due to costs, but also due to potential processing problems with greater amounts of additives present within the target fibers.

Another potentially preferred class of nucleators suitable for incorporation within the inventive colored fibers include saturated metal or organic salts of bicyclic dicarboxylates, preferably saturated metal or organic salts of bicyclic dicarboxylates, preferably, bicyclo[2.2.1]heptane-dicarboxylates, or, generally, compounds conforming to Formula (I)

(I)

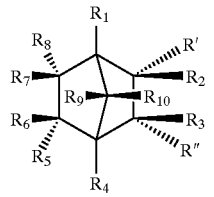

wherein $R_1$, $R_2$, $R_3$, $R_4$, $R_5$, $R_6$, $R_7$, $R_8$, $R_9$, and $R_{10}$ are individually selected from the group consisting of hydrogen, $C_1$–$C_9$ alkyl, hydroxy, $C_1$–$C_9$ alkoxy, $C_1$–$C_9$ alkyleneoxy, amine, and $C_1$–$C_9$ alkylamine, halogen, phenyl, alkylphenyl, and geminal or vicinal carbocyclic having up to nine carbon atoms, R' and R" are the same or different and are individually selected from the group consisting of hydrogen, $C_1$–$C_{30}$ alkyl, hydroxy, amine, polyamine, polyoxyamine, $C_1$–$C_{30}$ alkylamine, phenyl, halogen, $C_1$–$C_{30}$ alkoxy, $C_1$–$C_{30}$ polyoxyalkyl, C(O)—$NR_{11}$C(O)O—R'", and C(O)O—R'", wherein $R_{11}$ is selected from the group consisting of $C_1$–$C_{30}$ alkyl, hydrogen, $C_1$–$C_{30}$ alkoxy, and $C_1$–$C_{30}$ polyoxyalkyl, and wherein R'" is selected from the group consisting of hydrogen, a metal ion (such as, without limitation, $Na^+$, $K^+$, $Li^+$, $Ag^+$ and any other monovalent ions), an organic cation (such as ammonium as one non-limiting example), polyoxy-$C_2$–$C_{18}$-alkylene, $C_1$–$C_{30}$ alkyl, $C_1$–$C_{30}$ alkylene, $C_1$–$C_{30}$ alkyleneoxy, a steroid moiety (for example, cholesterol), phenyl, polyphenyl, $C_1$–$C_{30}$ alkylhalide, and $C_1C_{30}$ alkylamine; wherein at least one of R' and R" is either C(O)—$NR_{11}$C(O)O—R'" or C(O)O—R'", wherein if both R' and R" are C(O)OR'" then R'" both R' and R" may be combined into a single bivalent metal ion (such as $Ca^{2+}$, as one non-limiting example) or a single trivalent metal overbase (such as Al—OH, for one non-limiting example). Preferably, R' and R" are the same and R'" is either $Na^+$ or combined together for both R' and R" and $Ca^{2+}$. Other possible compounds are discussed in the preferred embodiment section below.

Preferably, as noted above, such a compound conforms to the structure of Formula (II)

(II)

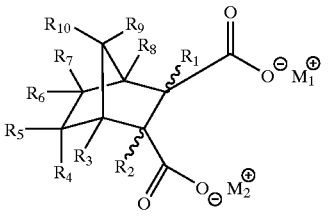

wherein $M_1$ and $M_2$ are the same or different and are independently selected from the group consisting of metal or organic cations or the two metal ions are unified into a single metal ion (bivalent, for instance, such as calcium, for example), and $R_1$, $R_2$, $R_3$, $R_4$, $R_5$, $R_6$, $R_7$, $R_8$, $R_9$, and $R_{10}$ are individually selected from the group consisting of hydrogen, $C_1$–$C_9$ alkyl, hydroxy, $C_1$–$C_9$ alkoxy, $C_1$–$C_9$ alkyleneoxy, amine, and $C_1$–$C_9$ alkylamine, halogen, phenyl, alkylphenyl, and geminal or vicinal carbocyclic having up to 9 carbon atoms. Preferably, the metal cations are selected from the group consisting of calcium, strontium, barium, magnesium, aluminum, silver, sodium, lithium, rubidium, potassium, and the like. Within that scope, group I and group II metal ions are generally preferred. Among the group I and II cations, sodium, potassium, calcium and strontium are preferred, wherein sodium and calcium are most preferred. Furthermore, the $M_1$ and $M_2$ groups may also be combined to form a single metal cation (such as calcium, strontium, barium, magnesium, aluminum, including monobasic aluminum, and the like). Although this invention encompasses all stereochemical configurations of such compounds, the cis configuration is preferred wherein cis-endo is the most preferred embodiment. The preferred embodiment polyolefin articles and additive compositions for polyolefin formulations comprising at least one of such compounds, broadly stated as saturated bicyclic carboxylate salts, are also encompassed within this invention.

As they apply to this invention, then, the terms "nucleators", "nucleator compound(s)", "nucleating agent", and "nucleating agents" are intended to generally encompass, singularly or in combination, any additive to polypropylene that produces nucleation sites for polypropylene crystals from transition from its molten state to a solid, cooled structure. Hence, since the polypropylene composition (including nucleator compounds in certain cases) must be molten to eventually extrude the fiber itself, the nucleator compound will provide such nucleation sites upon cooling of the polypropylene from its molten state. The only way in which such compounds provide the necessary nucleation sites is if such sites form prior to polypropylene recrystallization itself. Thus, any compound that exhibits such a beneficial effect and property is included within this definition. Such nucleator compounds more specifically include dibenzylidene sorbitol types, including, without limitation, dibenzylidene sorbitol (DBS), monomethyldibenzylidene sorbitol, such as 1,3:2,4-bis(p-methylbenzylidene) sorbitol (p-MDBS), dimethyl dibenzylidene sorbitol, such as 1,3:2,4-bis(3,4-dimethylbenzylidene) sorbitol (3,4-DMDBS); other compounds of this type include, again, without limitation, sodium benzoate, NA-11, NA-21, bicyclic dicarboxylate salts, and the like. The concentration of such nucleating agents (in total) within the target polypropylene fiber is at least 100 ppm, preferably at least 1250 ppm. Thus, from about 100 to about 5000 ppm, preferably from about 500 ppm to about 4000 ppm, more preferably from about 1000 ppm to about 3500 ppm, still more preferably from about 1500 ppm to about 3000 ppm, even more preferably from about 2000 ppm to about 3000 ppm, and most preferably from about 2500 to about 3000 ppm.

Also, without being limited by any specific scientific theory, it appears that the potential, but not required, nucleators which perform the best are those which exhibit relatively high solubility within the propylene itself. Thus, compounds which are readily soluble, such as 1,3:2,4-bis (p-methylbenzylidene) sorbitol provides the lowest shrinkage rate for the desired polypropylene fibers. The DBS derivative compounds are considered the best shrink-reducing nucleators within this invention due to the low crystalline sizes produced by such compounds. Other nucleators, such as NA-11, also impart acceptable characteristics to the target polypropylene fiber in terms of, for example, withstanding high speed spinning tensions; however, apparently due to poor dispersion of NA-11 in polypropylene and the large and varied crystal sizes of NA-11 within the fiber itself, the performance is less consistent than for the highly soluble, low crystal-size polypropylene produced by well-dispersed 3,4-DMDBS or, preferably, P-MDBS.

It has been determined that the nucleator compounds that exhibit good solubility in the target molten polypropylene resins (and thus are liquid in nature during that stage in the fiber-production process) provide more effective fiber properties for withstanding high speed spinning tension levels. Thus, substituted DBS compounds (including DBS, 3,4-DMDBS, and, preferably P-MDBS) appear to provide fewer manufacturing issues as well as lower shrink properties within the finished polypropylene fibers themselves. Although 3,4-DMDBS is preferred for such low denier fibers, any of the above-mentioned nucleators may be utilized within this invention. Mixtures of such nucleators may also be used during processing in order to provide such spinning efficiencies and low-shrink properties as well as possible organoleptic improvements, facilitation of processing, or cost.

In addition to those compounds noted above, sodium benzoate and NA-11 are well known as nucleating agents for standard polypropylene compositions (such as the aforementioned plaques, containers, films, sheets, and the like) and exhibit excellent recrystallization temperatures and very quick injection molding cycle times for those purposes. The dibenzylidene sorbitol types exhibit the same types of properties as well as excellent clarity within such standard polypropylene forms (plaques, sheets, etc.). For the purposes of this invention, it has been found that the dibenzylidene sorbitol types are preferred as nucleator compounds within the target polypropylene fibers.

Furthermore, such fibers may include other coloring agents, such as pigments, titanium dioxide, and the like, as well as fixing agents for lightfastness purposes. To that end, certain ultraviolet absorbers provide excellent protection from ultraviolet radiation and thus aids in reducing, if not preventing, color degradation due to such exposure. Any type of ultraviolet absorber compound or formulation that is dispersible within thermoplastics may be utilized within this invention. However, some non-limiting examples of such components include phenolic antioxidants, such as HOSTANOX® 245, O10, O14, O16, O3, and blends with HOSTANOX® M, all available from Clariant; processing stabilizers, such as HOSTANOX® PAR 24, SANDOSTAB® PEPQ (from Clariant), and blends with SANDOSTAB® QB; sulfur-containing co-stabilizers, such as HOSTANOX® SE 4 or SE 10; metal deactivators, such as HOSTANOX® OSP 1; light stabilizers, such as NYLOSTAB® S-EED (from Clariant, as well); and straightforward ultraviolet absorbers, such as CHIMASSORB® 2020, 944, 119, and/or 119FL, TINUVIN® 783, 353, 234, 1577, and/or 622 (all available from Ciba Specialty Chemicals). Preferred is TINUVIN® 783 for such a purpose.

In terms of providing effective colorations for brightness, it is further desirable to avoid pigments as nucleating agents; however, if desired, slight amounts of such pigments may be added for nucleation or coloration purposes if such are desired end results. Other additives may also be present, including antistatic agents, brightening compounds, clarifying agents, antioxidants, antimicrobials (preferably silver-based ion-exchange compounds, such as ALPHASAN® antimicrobials available from Milliken & Company), fillers, and the like. Furthermore, any fabrics made from such inventive fibers may be, without limitation, woven, knit, non-woven, in-laid scrim, any combination thereof, and the like. Additionally, such fabrics may include fibers other than the inventive polypropylene fibers, including, without limitation, natural fibers, such as cotton, wool, abaca, hemp, ramie, and the like; synthetic fibers, such as polyesters, polyamides, polyaramids, other polyolefins (including non-low-shrink polypropylene), polylactic acids, and the like; inorganic fibers such as glass, boron-containing fibers, and the like; and any blends thereof.

In addition, this invention can be practiced with any melt extrudable thermoplastic polymer, such as polyester, nylon, poly lactic acid, and the like, with similar results.

Such inventive fibers can be included in a fabric such as a carpet, upholstery fabric, woven fabric, knit fabric, nonwoven, pile fabric, netting, and the like. In addition, these fibers can be combined in such fabric structures as accent yarns, especially if the additional non-inventive fibers are dye accepting. In such a case, the inventive yarns provide accent yarns with bright appearance. In addition, individual yarns may be incorporated within non-fabric structures, such as, as one non-limiting example, fishing lures, and other end-uses in which brightly colored strong fibers are desirable.

Inventive yarns and fibers can be used in any standard textile process, including, without limitation, such methods as yarn texturing processes such as stuffer box, bulk continuous filament (BCF), air jet texturing, twisting, false twist testing, and the like. They can also be combined with other yarns or used in other processes to make "elegant" or "fancy" yarns, such as chenille, slub yarns, stria yarns, etc., with all of the incumbent advantages of combining the technologies. In addition, the transparent nature of the color can be used in light weight fabrics to make colored transparent fabrics such as may be desirable to show a pattern on a substrate covered by the inventive fabric.

BRIEF DESCRIPTION OF THE DRAWINGS

The accompanying drawings, which are incorporated in and constitute a part of this specification, illustrate a potentially preferred embodiment of producing the inventive low-shrink polypropylene fibers and together with the description serve to explain the principles of the invention wherein.

DETAILED DESCRIPTION OF THE DRAWING AND OF THE PREFERRED EMBODIMENT

Figure 1:
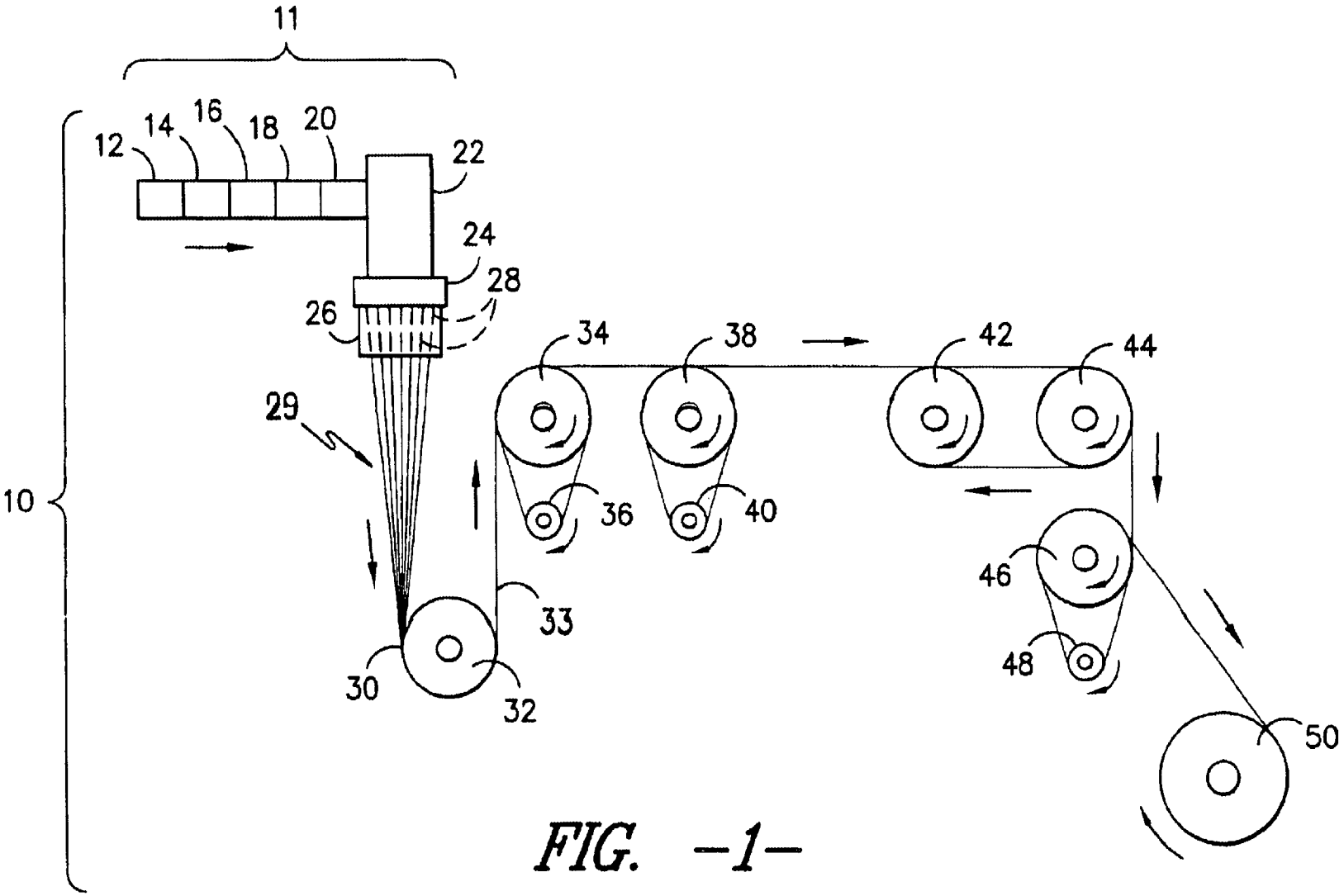
FIG. 1 is a schematic of the potentially preferred method of producing colored polypropylene fibers through typical spinning machinery.

FIG. 1 depicts the non-limiting preferred procedure followed in producing the inventive low denier polypropylene fibers. The entire fiber production assembly 10 comprises an extruder 11 including a metering pump (not illustrated) for introduction of specific amounts of polymer into the extruder 11 (to control the denier of the ultimate target manufactured fiber and/or yarn) which also comprises four [five] different zones 12, 14, 16, 18, 20 through which the polymer (not illustrated) passes at different, increasing temperatures. The molten polymer is mixed with the liquid polymeric colorant (here, Example 1 from the Colorant Table, above, preferably) within a mixer zone 22. Basically, the polymer (not illustrated) is introduced within the fiber production assembly 10, in particular within the extruder 11. The temperatures, as noted above, of the individual extruder zones 12, 14, 16, 18, 20 and the mixing zone 22 are as follows: first extruder zone 12 at 210° C., second extruder zone 14 at 220° C., third extruder zone 16 at 230° C., fourth extruder zone 18 at 235° C., [fifth extruder zone 20 at 240° C.,] and mixing zone 22 at 240° C. The molten polymer (not illustrated) then moves into a spinneret area 24 set at a temperature of 240° C. for strand extrusion. All such temperatures may be modified as needed, and these levels are non-limiting and simply potentially preferred. The fibrous strands 28 then pass through an air-blown treatment shroud [area] 26 set at a temperature of 175° C. and then through a treatment area 29 whereupon a lubricant, such as water or an oil, is applied thereto the strands 28. The strands 28 are then collected into a bundle 30 via a take-up roll 32 to form a multifilament yarn 33 which then passes to a series of tensioning rolls 34, 36 prior to drawing. The yarn 33 then passes through a series of two different sets of draw rolls 38, 40, 42, 44 which increase the speed of the collected finished strands 33 as compared with the speed of the initially extruded strands 28. The finished strands 33 extend in length due to a greater pulling speed in excess of such an initial extrusion speed within the extruder 11. The strands 33 are then passed through a series of relax rolls 46, 48 and ultimately to a winder 50 for ultimate collection on a spool (not illustrated). The speed of the winder 50 ultimately dictates the speed and efficiency of the entire apparatus in terms of permitting high speed manufacturing and spinning (drawing) with minimal, if any, breakage of the target fibers during such a procedure. The draw rolls are heated to a very low level as follows: first draw rolls 38, 40 60–70° C. and the second set of draw rolls 42, 44 80–90° C., as compared with the remaining areas of high temperature exposure as well as comparative fiber drawing processes. The draw rolls 38, 40, 42, 44 individually and, potentially independently rotate at a speed of from about 1000 meters per minute to as high as about 5000 meters per minute. The second draw rolls 42, 44 generally rotate at a higher speed than the first in excess of about 800 meters per minute up to 1000 meters per minute over those of the first set.

Figure 2:
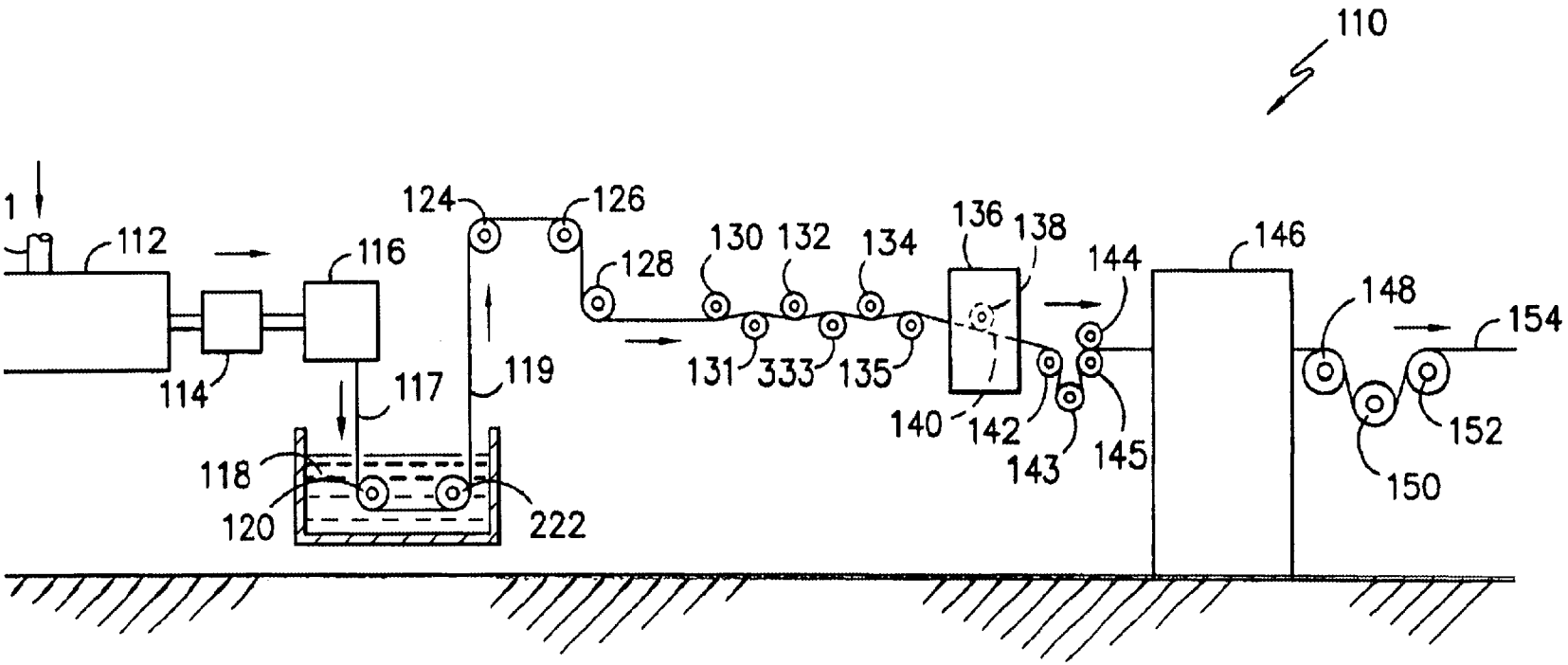
FIG. 2 is a schematic of the potentially preferred method of producing colored polypropylene tape fibers.

FIG. 2 depicts the non-limiting preferred procedure followed in producing the inventive low-shrink polypropylene tape fibers. The entire fiber production assembly 110 comprises a mixing manifold 111 for the incorporation of molten polymer and additives (such as the aforementioned nucleator compound) which then move into an extruder 112. The extruded polymer is then passed through a metering pump 114 to a die assembly 116, whereupon the film 117 is produced. The film 117 then immediately moves to a quenching bath 118 comprising a liquid, such as water, and the like, set at a temperature from 5 to 95° C. (here, preferably, about room temperature). The drawing speed of the film at this point is dictated by draw rolls and tensionsing rolls 120, 122, 124, 126, 128 set at a speed of about 100 feet/minute, preferably, although the speed could be anywhere from about 20 feet/minute to about 200 feet/minute, as long as the initial drawing speed is at most about $1/5^{th}$ that of the heat-draw speed later in the procedure. The quenched film 119 should not exhibit any appreciable crystal orientation of the polymer therein for further processing. Sanding rolls 130, 131, 132, 133, 134, 135, may be optionally utilized for delustering of the film, if desired. The quenched film 119 then moves into a cutting area 36 with a plurality of fixed knives 138 spaced at any distance apart desired. Preferably, such knives 138 are spaced a distance determined by the equation of the square root of the draw speed multiplied by the final width of the target fibers (thus, with a draw ratio of 5:1 and a final width of about 3 mm, the blade gap measurements should be about 6.7 mm). Upon slitting the quenched film 119 into fibers 140, such fibers are moved uniformly through a series of nip and tensioning rolls 142, 143, 144, 145 prior to being drawn into a high temperature oven 146 set at a temperature level of between about 280 and 350° C., in this instance about 310° C., at a rate as noted above, at least 5 times that of the initial drawing speed. Such an increased drawing speed is effectuated by a series of heated drawing rolls 141, 150 (at temperatures of about 360–400° F. each) over which the now crystal-oriented fibers 154 are passed. A last tensioning roll 152 leads to a spool (not illustrated) for winding of the finished tape fibers 154.

Figure 3:
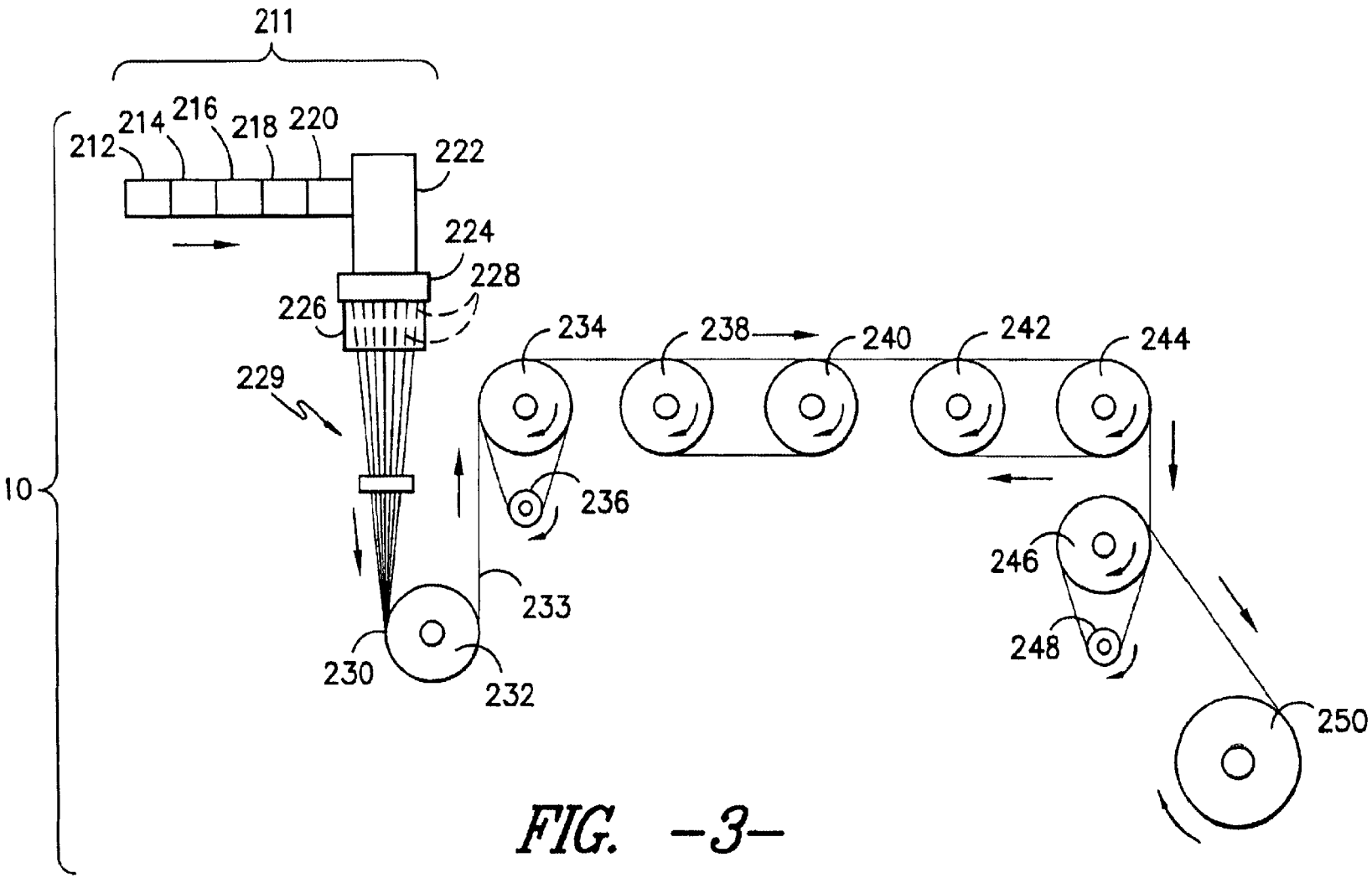
FIG. 3 is a schematic of the potentially preferred method of producing colored polypropylene fibers through typical high-speed spinning machinery.

FIG. 3 depicts the non-limiting preferred procedure followed in producing the inventive low denier polypropylene fibers. The entire fiber production assembly 210 comprises an extruder 211 including a metering pump (not illustrated) for introduction of specific amounts of polymer into the extruder 211 (to control the denier of the ultimate target manufactured fiber and/or yarn) which also comprises five different zones 212, 214, 216, 218, 220 through which the polymer (not illustrated) passes at different, increasing temperatures. The molten polymer is mixed with the nucleator compound (also molten) within a mixer zone 222. Basically, the polymer (not illustrated) is introduced within the fiber production assembly 210, in particular within the extruder 211. The temperatures, as noted above, of the individual extruder zones 212, 214, 216, 218, 220 and the mixing zone 22 are as follows: first extruder zone 212 at 205° C., second extruder zone 214 at 215° C., third extruder zone 216 at 225° C., fourth extruder zone 218 at 235° C., fifth extruder zone 220 at 240° C., and mixing zone 222 at 245° C. The molten polymer (not illustrated) then moves into a spinneret area 224 set at a temperature of 250° C. for strand extrusion. All such temperatures may be modified as needed, and these levels are non-limiting and simply potentially preferred. The fibrous strands 228 then pass through an air-blown treatment area 226 and then through a treatment area 229 whereupon a lubricant, such as water or an oil, is applied thereto the strands 228. The strands 228 are then collected into a bundle 230 via a take-up roll 232 to form a multifilament yarn 233 which then passes to a series of tensioning rolls 234, 236 prior to drawing. The yarn 233 then passes through a series of two different sets of draw rolls 238, 240, 242, 244 which increase the speed of the collected finished strands 233 as compared with the speed of the initially extruded strands 228. The finished strands 233 extend in length due to a greater pulling speed in excess of such an initial extrusion speed within the extruder 211. The strands 233 are then passed through a series of relax rolls 246, 248 and ultimately to a winder 250 for ultimate collection on a spool (not illustrated). The speed of the winder 250 ultimately dictates the speed and efficiency of the entire apparatus in terms of permitting high speed manufacturing and spinning (drawing) with minimal, if any, breakage of the target fibers during such a procedure. The draw rolls are heated to a very low level as follows: first draw rolls 238, 240 68° C. and the second set of draw rolls 242, 244 88° C., as compared with the remaining areas of high temperature exposure as well as comparative fiber drawing processes. The draw rolls 238, 240, 242, 244 individually and, potentially independently rotate at a speed of from about 1000 meters per minute to as high as about 5000 meters per minute. The second draw rolls 242, 244 generally rotate at a higher speed than the first in excess of about 800 meters per minute up to 1000 meters per minute over those of the first set.

Figure 4:
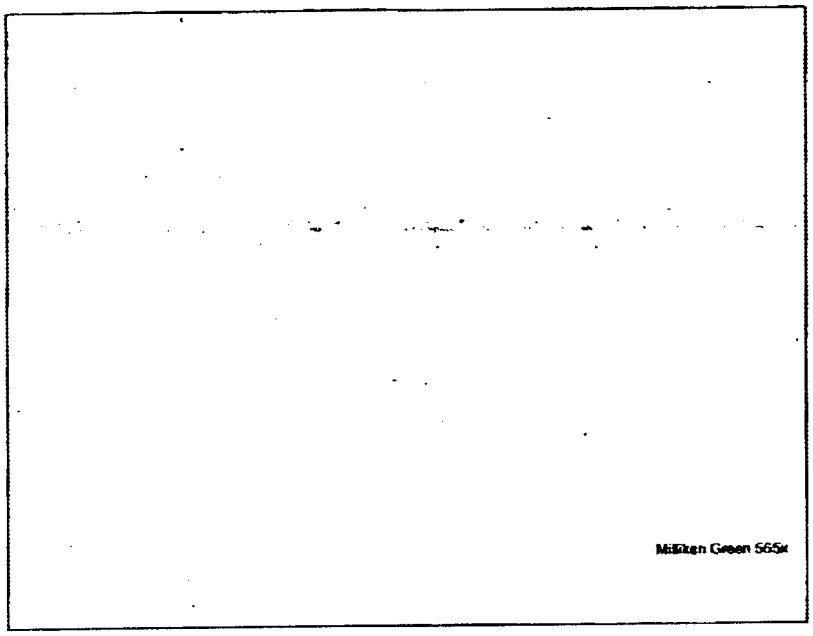
FIG. 4 is a side-view color microphotograph of a green-colored inventive polypropylene fiber magnified at 565× colored with a liquid polymeric colorant.

In FIG. 4, the presence of rod-like structures of color is evident throughout the fiber. Such rod-like structures are basically the liquid polymeric colorants stretched in the same manner as the resin fiber is stretched during extrusion. The shear of extrusion forms long high aspect ratio rod-like configurations of liquid colorant within the target fiber. Such a rod-like structure thus imparts colorations to the target fiber while simultaneously allowing transmission of light therethrough. As such, the fiber remains transparent to light, thereby exhibiting an increased brightness and luster. Furthermore, these rod-like structures, although they remain liquid in nature, are not in individual pools of color, but are stretched in such a rod-like manner, such that the liquid component cannot be easily extracted from within the target fiber without damaging the fiber itself.

Figure 5:
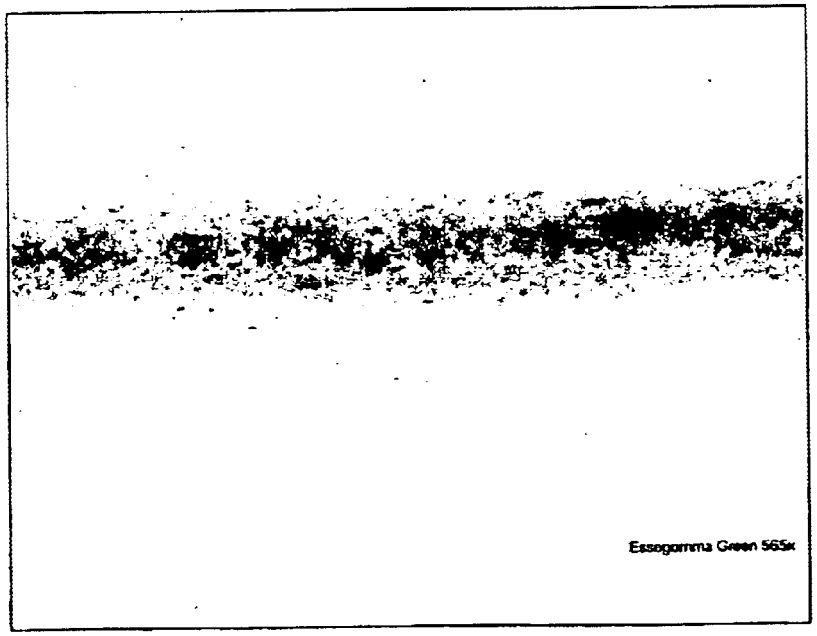
FIG. 5 is a side-view color microphotograph of a comparative green-colored polypropylene yarn magnified at 565× having pigments present throughout.

In FIG. 5, the presence of pigment particles is evident throughout the fiber. Such pigment particles are solid in nature. The color imparted to the target fiber is thus substantially reliant upon absorption of light by such solid particles. There is little chance of light transmission through the fiber such that the fiber lacks transparency. As a result, brightness and luster are compromised such that the fiber exhibits a dulling effect, particularly in comparison with the fiber of FIG. 4.

Figure 6:
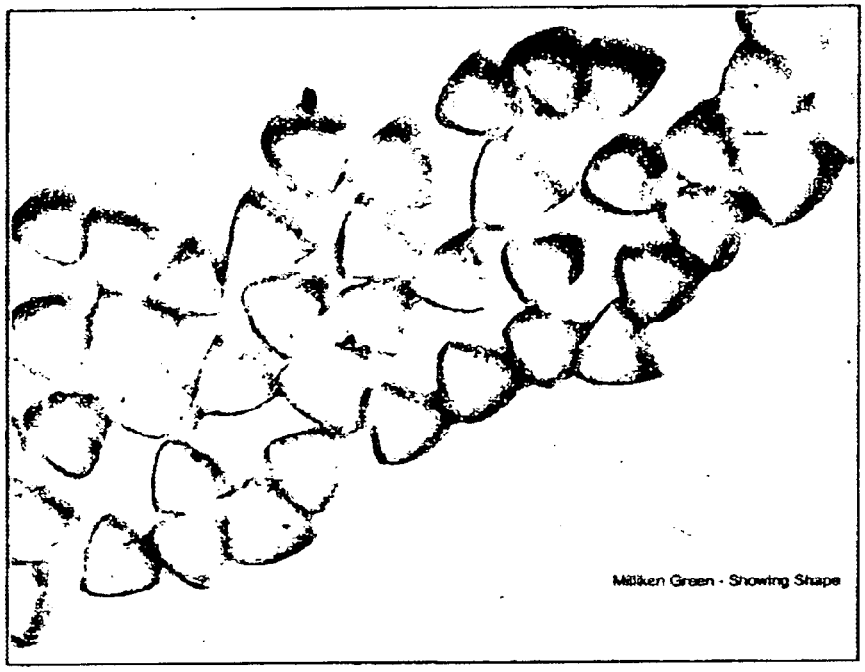
FIG. 6 is a cross-sectional view of a plurality of green-colored inventive polypropylene fibers magnified at 565× colored with a liquid polymeric colorant.

In FIG. 6, the presence of "dots" of color can be seen within the cross-sectional views of the target fibers (as in FIG. 4). Such "dots" are the portions of the rod-like high aspect ratio structures of the liquid colorants that were stretched during extrusion. The plurality of "dots" thus shows the inclusion of numerous different rod-like structures throughout individuals fibers. Coupled with the side view (as in FIG. 4), it can be seen how a liquid coloring agent (polymeric type, preferably, though not necessarily) is stretched from a starting pool of liquid into this high aspect ratio strand (rod-like structure).

Inventive Fiber and Yarn Production

EXAMPLE 1

Polymeric Colorant Fibers

Yarns were made using a commercially available polypropylene fiber grade resin Amoco 7550 (melt flow of 18), using a standard fiber spinning apparatus as described previously. The five colorants from the COLORANT TABLE, above, were formed into 10% concentrates premixed with fiber grade polypropylene resin and fed into the hopper of the extruder during fiber extrusion. In one preferred embodiment, fiber grade resin polypropylene was fed into the extruder on an Alex James & Associates multifilament fiber extrusion line as noted above in FIG. 1 along with a 10% color concentrate including the required liquid polymeric colorants. Yarn was produced with the extrusion line conditions shown in Table 1 using a 68 hole spinneret, giving a yarn of nominally 150 denier. The godet roll temperatures were 67° C. (for 38, 40 in FIG. 1), 85° C. (for 42, 44), and 125° C. (for 46, 48), respectively, with a nominal winder speed of about 1300 m/min. Pigmented fibers were also made for comparative purposes.

The extruder and cooling conditions were as follows:

TABLE #1

| Procedural Conditions | |
|---|---|
| Extruder Temperature Zone #1 | 210° C. |
| Extruder Temperature Zone #2 | 220° C. |
| Extruder Temperature Zone #3 | 230° C. |
| Extruder Temperature Zone #4 | 235° C. |
| Mixer Temperature | 240° C. |
| Spinneret Temperature #1 | 240° C. |
| Spinneret Temperature #2 | 240° C. |
| Shroud Temperature | 175° C. |

Winder take-up speeds of 1290 m/min with draw ratios of approximately 3.5 were utilized and deniers between 150 and 200 were produced. A minimum of 3 samples were produced with concentrations of ½ and or 1% color in the Amoco 7550 for each of the colors. Extrusion conditions and physical properties of these samples are detailed in the following tables. Additionally, comparative pigmented samples were produced with three pigments provided by Standridge Color Concentrate 86600 blue 25% GSP, fade red HUV and yellow HG 25% which are identified in the table below as blue, red and yellow pigment, respectively.

TABLE #2

Procedural Conditions
Fiber Extrusion Conditions

| Sample ID | Polymer | Color | Color Level | Draw Ratio | Heat Set (° C.) |
|---|---|---|---|---|---|
| 1 | Amoco 7550 | None | 0 | 3.49 | 125 |
| 2 | Amoco 7550 | None | 0 | 4.56 | 125 |
| 3 | Amoco 7550 | None | 0 | 3.44 | 125 |
| 4 | Amoco 7550 | 10% Colorant #3 | 0.5 | 4.56 | 125 |

TABLE #2-continued

Procedural Conditions
Fiber Extrusion Conditions

| Sample ID | Polymer | Color | Color Level | Draw Ratio | Heat Set (° C.) |
|---|---|---|---|---|---|
| 5 | Amoco 7550 | 10% Colorant #3 | 0.5 | 3.44 | 125 |
| 6 | Amoco 7550 | 10% Colorant #3 | 0.5 | 3.53 | 125 |
| 7 | Amoco 7550 | 10% Colorant #5 | 0.5 | 3.49 | 125 |
| 8 | Amoco 7550 | 10% Colorant #5 | 0.5 | 3.44 | 125 |
| 9 | Amoco 7550 | 10% Colorant #5 | 0.5 | 4.56 | 125 |
| 10 | Amoco 7550 | 10% Colorant #2 | 0.5 | 3.44 | 125 |
| 11 | Amoco 7550 | 10% Colorant #2 | 1.0 | 3.44 | 125 |
| 12 | Amoco 7550 | 10% Colorant #2 | 1.0 | 3.44 | 125 |
| 13 | Amoco 7550 | 10% Colorant #2 | 1.0 | 3.55 | 125 |
| 14 | Amoco 7550 | 10% Colorant #4 | 0.5 | 3.49 | 125 |
| 15 | Amoco 7550 | 10% Colorant #4 | 0.5 | 3.94 | 125 |
| 16 | Amoco 7550 | 10% Colorant #4 | 0.5 | 4.56 | 125 |
| 17 | Amoco 7550 | 10% Colorant #1 | 0.5 | 4.56 | 125 |
| 18 | Amoco 7550 | 10% Colorant #1 | 0.5 | 3.44 | 125 |
| 19 | Amoco 7550 | 10% Colorant #1 | 0.5 | 3.53 | 125 |
| 20 | Amoco 7550 | Blue Pigment | 0.5 | 3.44 | 125 |
| 21 | Amoco 7550 | Red Pigment | 0.5 | 3.44 | 125 |
| 22 | Amoco 7550 | Yellow Pigment | 0.5 | 3.44 | 125 |

TABLE #1

Experimental
Fiber Properties

| Sample ID | Denier (g/9000 m) | Elongation (%) | Tenacity (g/den) | 3% Modulus (g/den) | 130C Shrinkage (%) |
|---|---|---|---|---|---|
| 1 | 153.8 | 53.0 | 4.6 | 41.6 | 6.6 |
| 2 | 85.7 | 32.1 | 6.5 | 67.9 | 9.9 |
| 3 | 159.7 | 67.9 | 4.7 | 44.4 | 11.1 |
| 4 | 172.7 | 61.5 | 5.0 | 44.0 | 14.8 |
| 5 | 147.4 | 74.4 | 4.6 | 42.4 | 8.5 |
| 6 | 150.7 | 66.1 | 4.2 | 38.9 | 9.6 |
| 7 | 149.5 | 41.1 | 4.4 | 41.2 | 7.2 |
| 8 | 155.1 | 54.7 | 4.1 | 38.7 | 8.0 |
| 9 | 169.2 | 46.6 | 5.6 | 51.0 | 10.4 |
| 10 | 156.2 | 51.1 | 5.0 | 43.9 | 13.6 |
| 11 | 181.0 | 50.0 | 4.6 | 42.8 | 9.0 |
| 12 | 153.8 | 46.6 | 4.9 | 45.3 | 9.5 |
| 13 | 153.6 | 35.5 | 4.8 | 45.4 | 13.6 |
| 14 | 154.1 | 47.7 | 4.3 | 39.5 | 11.2 |
| 15 | 151.4 | 48.0 | 4.4 | 41.8 | 7.0 |
| 16 | 168.8 | 27.0 | 5.3 | 51.4 | 15.3 |
| 17 | 177.3 | 44.8 | 5.2 | 46.7 | 11.5 |
| 18 | 149.9 | 58.1 | 4.6 | 43.4 | 11.7 |
| 19 | 150.7 | 48.4 | 4.6 | 43.0 | 14.8 |
| 20 | 153.7 | 84.7 | 3.8 | 35.8 | N/A |
| 21 | 150.7 | 66.8 | 3.3 | 35.8 | N/A |
| 22 | 151.6 | 40.6 | 4.3 | 40.8 | N/A |

The above samples have similar physical properties to those of fibers spun with pigments (solution dyed) in the same polypropylene resin, however the luster of the colors is significantly different. It is also important to note that the polymeric colorants are generally non-nucleating and will, under the same processing conditions have similar physical properties while the pigments (specifically the blue pigment—Sample 20) generally are nucleating which often requires the fiber spinning equipment to be operated under different conditions to obtain similar physical properties—note the higher elongation of sample 20 in comparison to samples 21 and 22.

EXAMPLE 2

Polymeric Colorant Fibers with $TiO_2$ and Pigments

A series of polypropylene samples was produced under the standard fiber spinning conditions described in Example 1 to test the ability to combine both solid pigments and liquid polymeric colorants in the same fibers. The drawing conditions for these example yarns are detailed in the following table.

TABLE #3

| | Procedural Conditions Spinning Conditions | |
|---|---|---|
| | Roll Speed (m/min) | Roll Temperature ° C. |
| Feed Roll | 800 | Not heated |
| Draw Roll 1 | 805 | 55 |
| Draw Roll 2 | 1450 | 75 |
| Draw Roll 3 (A + B) | 2000 | 120 |
| Relax Roll | 1980 | Not heated |

Using the standard fiber spinning conditions as described above, a series of 10 experiments were performed to produce samples with liquid polymeric colorants labeled by Milliken & Company Product numbers, and $TiO_2$ which is commonly used in the production of thermoplastic fibers to produce dull (9% $TiO_2$) and semi-dull (3% $TiO_2$) appearance. The fibers were successfully produced at all of the conditions tested and the list of colorants, $TiO_2$ levels and fiber properties are detailed in the Table below using polymeric liquid colorant mixtures available from Milliken & Company under the tradename CLEARTINT®.

TABLE #2

| | | Fiber Properties | | | | | |
|---|---|---|---|---|---|---|---|
| Sample ID | Polymeric Color (Color/ Number) | Polymeric Color Concentrate Level (%) | $TiO_2$ Level (%) | Denier (g/9000 m) | Elongation (%) | Tenacity (g/den) | 5% Secant Modulus (g/den) |
| T1 | Blue 9805 | 20 | N/A | 166 | 50.60 | 4.626 | 32.49 |
| T2 | Blue 9805 | 20 | 9 | 152 | 57.20 | 5.345 | 37.40 |
| T3 | Blue 5603 | 10 | N/A | 153 | 53.44 | 5.872 | 42.94 |
| T4 | Blue 5603 | 5 | 3 | 157.92 | 47.75 | 5.053 | 39.01 |
| T5 | Smoke 9809 | 10 | N/A | 161 | 31.56 | 4.323 | 37.81 |
| T6 | Smoke 9809 | 10 | 3 | 158 | 39.79 | 4.824 | 37.56 |
| T7 | Amber 9808 | 20 | N/A | 164 | 51.38 | 4.898 | 36.89 |
| T8 | Amber 9808 | 20 | 3 | 161 | 57.77 | 4.83 | 34.70 |
| T9 | Green 5062 | 10 | N/A | 158 | 51.81 | 5.225 | 40.38 |
| T10 | Green 5062 | 5 | 3 | 153 | 54.55 | 5.42 | 40.50 |

In addition to experiments with $TiO_2$ a series of experiments were conducted to determine the viability of spinning polypropylene fibers with the liquid polymeric colorants and standard fiber pigments. A series of 8 experiments, listed in the table below, were produced under the standard spinning conditions described above. The pigments, obtained from Standridge Color Concentrate, Social Circle, Ga., are commercially available and are typical of the pigments used within the polypropylene fiber industry. Specifically, the green pigment is identified as SCC 3654, the red pigment is SCC 4591 and the black pigment is SCC 23005. The polymeric colorants in these example experiments are identified as PP Green 5720, PP Red 5718, and PP Smoke 5719 for the green, red and black liquid polymeric colorant respectively (all available under the tradename CLEARTINT® from Milliken & Company).

TABLE #2

| | | Fiber Additives | | |
|---|---|---|---|---|
| Sample ID | Color | Polymer Colorant Level (%) | Pigment Level (%) | TiO2 Level (%) |
| P1 | Green | 1.8 | 0 | 0 |
| P2 | Green | 1.5 | 1.5 | 0 |
| P3 | Green | 0 | 1.5 | 0 |
| P4 | Red | 0 | 1.5 | 9 |
| P5 | Red | 2 | 1.5 | 9 |
| P6 | Black | 0 | 1.5 | 0 |
| P7 | Black | 2 | 0 | 0 |
| P8 | Black | 2 | 1.5 | 0 |

EXAMPLE 3

Polymeric Colorant Fibers with Nucleators

A series of experiments were conducted using commercially available nucleators in combination with the liquid polymeric colorants (from the COLORANT TABLE, above) to produce continuous filament fibers. Using the same conditions as described in Example 1 above, 13 samples were produced using a commercially available polypropylene nucleator, Millad 3940 (MDBS). Fiber compositions for the 13 experimental samples are found in Fiber Additives Table #3 below and the physical properties of the final fibers are found in Fiber Properties Table #4.

TABLE #3

| | | | Fiber Additives Nucleated Fiber Conditions | | | | |
|---|---|---|---|---|---|---|---|
| Sample ID | Polymer | Additive | Additive Level (ppm) | Color | Color Level % | Heat Set (C) | Draw Ratio |
| A | Amoco 7550 | M3940 | 2750 | 10% Colorant #3 | 0.5 | 125 | 4.0 |
| B | Amoco 7550 | M3940 | 2750 | 10% Colorant #3 | 0.5 | 125 | 5.1 |
| C | Amoco 7550 | M3940 | 2750 | 10% Colorant #3 | 0.5 | 125 | 3.4 |
| D | Amoco 7550 | M3940 | 2750 | 10% Colorant #5 | 0.5 | 125 | 3.4 |

TABLE #3-continued

| Sample ID | Polymer | Fiber Additives Nucleated Fiber Conditions Additive | Additive Level (ppm) | Color | Color Level % | Heat Set (C) | Draw Ratio |
|---|---|---|---|---|---|---|---|
| E | Amoco 7550 | M3940 | 2750 | 10% Colorant #2 | 0.5 | 125 | 4.0 |
| F | Amoco 7550 | M3940 | 2750 | 10% Colorant #2 | 0.5 | 125 | 3.4 |
| G | Amoco 7550 | M3940 | 2750 | 10% Colorant #2 | 0.5 | 125 | 5.1 |
| H | Amoco 7550 | M3940 | 2750 | 10% Colorant #4 | 0.5 | 125 | 5.1 |
| I | Amoco 7550 | M3940 | 2750 | 10% Colorant #4 | 0.5 | 125 | 4.0 |
| J | Amoco 7550 | M3940 | 2750 | 10% Colorant #4 | 0.5 | 125 | 3.4 |
| K | Amoco 7550 | M3940 | 2750 | 10% Colorant #1 | 0.5 | 125 | 5.1 |
| L | Amoco 7550 | M3940 | 2750 | 10% Colorant #1 | 0.5 | 125 | 4.0 |
| M | Amoco 7550 | M3940 | 2750 | 10% Colorant #1 | 0.5 | 125 | 3.4 |

TABLE #4

| Sample ID | Denier (g/9000 m) | Elongation (%) | Tenacity (g/den) | 3% Modulus (g/den) | 130C Shrinkage (%) |
|---|---|---|---|---|---|
| | | Fiber Properties Colored and Nucleated Fibers | | | |
| A | 129 | 65.996 | 4.805 | 46.823 | 8.524 |
| B | 152.5 | 41.467 | 5.555 | 56.61 | 9.64 |
| C | 154.5 | 93.919 | 3.939 | 36.697 | 6.595 |
| D | 151.1 | 73.769 | 3.825 | 39.584 | 6.973 |
| E | 131 | 30.29 | 4.474 | 46.237 | 8.678 |
| F | 155.4 | 40.265 | 3.446 | 36.636 | 5.995 |
| G | 160.4 | 28.747 | 5.044 | 52.14 | 8.136 |
| H | 153.8 | 23.227 | 5.208 | 52.764 | 8.893 |
| I | 134 | 23.895 | 3.94 | 39.574 | 8.79 |
| J | 151.3 | 50.934 | 3.06 | 32.392 | 7.019 |
| K | 163.4 | 20.941 | 5.218 | 54.94 | 9.255 |
| L | 132.1 | 37.146 | 4.768 | 50.275 | 8.849 |
| M | 159.7 | 72.707 | 3.309 | 34.248 | 6.976 |

Additionally using other commercially available nucleator compounds a series of yarns were produced using a Basell 35MFI fiber grade resin, Grade PDC-1302, using the green liquid colorant (PP Green 5720). In each case 1.2% of the green liquid colorant were combined with 2500 ppm of Millad 3940 (MDBS), Millad 3988 (DMDBS), HPN-68 and NA-21.

EXAMPLE 4

Polymeric Colorant Fibers with UV Absorbers

To test the spinnablity of polypropylene fibers with both the liquid polymeric colorants and a range of UV stablizers, 10 samples using a 10% concentrate of Yellow 485 polymeric colorant and various UV stabilizers were generated. The 10 samples were spun under standard sampling conditions as described in Example 2 above. The table below details the combinations and amounts of UV stabilizers with two different concentrations of the yellow colorant from the COLORANT TABLE, above.

TABLE #4

| Sample ID | Colorant Concentration (%) | UV Stabilizer (name) | UV Stabilizer Concentration (ppm) |
|---|---|---|---|
| | | Fiber Additives | |
| Y1 | 2 | Tinuvin 783 | 1000 |
| Y2 | 1 | N/A | N/A |
| Y3 | 1 | Tinuvin 783 | 1000 |
| Y4 | 1 | Tinuvin 783 | 2000 |
| Y5 | 1 | Tinuvin 783 | 500 |
| Y6 | 1 | Tinuvin 783 | 10000 |
| Y7 | 1 | Tinuvin 783 | 15000 |
| Y8 | 1 | Tinuvin 622 | 10000 |
| Y9 | 1 | Chimassorb 844 | 10000 |
| Y10 | 2 | Tinuvin 783 | 10000 |

EXAMPLE 5

Textured Polymeric Colorant Fibers

Yarns containing 1% of the polymeric colorants PP Orange 9802 and PP Violet 9804 were air jet textured. The starting yarns were 150 denier, 72 filament yarns with standard physical properties produced in the same manner as those fibers described in Example #1 above. Two orange yarns were air jet textured with one violet yarn to produce a collaged air jet textured yarn.

EXAMPLE 6

Polymeric Colorant Fibers from Liquid Colorant Injection

For two colors, a second set of yarns was produced by directly injecting the liquid colorant into the feed throat of the extruder of the fiber spinning equipment. Basell PDC-1302, a 35 MFI HPP, was fed into the extruder at an extrusion temperature of 200° C. The polymeric colors were then injected directly into the hopper of the extrusion line using a peristaltic pump (Maguire, Model PA-6-18). In each case the pump was set to the lowest possible setting, due to size of the extrusion line and the throughput of the melt pump. The two colorants used were 10% concentrates of the violet and red colorants from the COLORANT TABLE, above. All yarns were produced under the spinning conditions described in Table 5 below.

TABLE #5

| | Roll Speed (m/min) | Roll Temperature ° C. |
|---|---|---|
| | Procedural Conditions | |
| Feed Roll % | 500 | Not Heated |
| Draw Roll 1 | 505 | 55 |
| Draw Roll 2 | 1000 | 75 |
| Draw Roll 3 (A + B) | 1250 | 120 |
| Relax Roll | 1240 | Not Heated |

At these conditions, yarns of different deniers were produced by adjusting the melt pump speed.

EXAMPLE 7

Polymeric Colorant Monofilament

Polymeric colorant concentrates were let down into two PP resins: the first with an MFI of 12–18 g/10 min (Exxon 1154) and the second with an MFI of 4 g/10 min (Exxon 2252) at a level of 10% to give 1% colorant in the final polymer fiber. This mixture, consisting of PP resin and the polymeric colorant additive, was extruded using a single screw extruder through monofilament spinnerets with 60 holes. The PP melt throughput was adjusted to give a final monofilament denier of approximately 520 g/9000 m. The molten strands of filament were quenched in room temperature water (about 25° C.), and then transferred by rollers to a battery of airs knives, which dried the filaments. The filaments, having been dried, were run across the first of four sets of large rolls, all rotating at a speed of between 49 and 126 ft/min (dependent on draw ratio), before entering an oven approximately 14 ft long set to a temperature of 360° F. After leaving the first oven, the filaments were transferred to the second set of large rollers running at a speed of 524 ft/min (dependent on draw ratio) and then into second oven, set at a temperature of 360° F. The final two sets of rolls were both set at 630 ft/min and the oven between them was set at a temperature of 300° F. The individual monofilament fibers were then traversed to winders where they were individually wound. These final fibers are thus referred to as the PP monofilaments. Several monofilament fibers were made in this manner with the following PP Red 9803, PP Violet 9804, PP Blue 9805, and PP Green 9807.

EXAMPLE 8

Melt Blown Non-Woven with Polymeric Colorants

A colored melt blown non-woven fabric was produced using a Nordson Fiber systems pilot melt blown system. The equipment consisted of a ¾ single screw extruder (24:1) L:D ratio manufactured by J/M Laboratories—Model DTMB. The airflow was set to 30 scfm with a max temperature of 625F. The orange colorant from the COLORANT TABLE, above, in a 10% concentrate, was let down into Basell 35 MFI fiber grade resin to give a final color loading of 1% in the melt blown fabric.

EXAMPLE 9

Polyester Polymeric Colorant Fibers from Liquid Color Injection

A set of experiments similar to Example #6 was conducted using a low IV (0.62) PET resin. Two liquid polymeric colorants, PET Yellow 236 and PET Orange 226, available from Milliken & Company, were used to produce yarn samples. Free fall fiber was collected from the spinneret, which had the similar vibrant color as seen with the polypropylene fibers of Example 6.

EXAMPLE 10

BCF Fibers Including Liquid Polymeric Colorants

Cyan 9806 (from Milliken & Company) polymeric colorant was used to produce a colored bulk continuous filament (BCF) textured PP yarn. A three ply BCF 300 denier 72 filament yarn was produced using standard BCF equipment. Additionally using the liquid polymeric PP Orange 9802 colorant a single ply BCF 250 denier 72 filament textured yarn was also produced using standard BCF equipment. The colorant was added to the extrusion line using a 10% concentrate to give a final color level of 1% in the yarns.

Knitted structures (socks) of the above Examples (except for Example #8 which was already made into a non-woven fabric) were then produced.

There are, of course, many alternative embodiments and modifications of the present invention which are intended to be included within the spirit and scope of the following claims.

What we claim is:

1. A polypropylene fiber comprising at least one liquid polymeric colorant and at least one nucleator compound, therein, wherein said at least one liquid polymeric colorant defines a plurality of elongate colored rods within said fiber.

2. The fiber in claim 1 wherein said fiber is present as a structure selected from the group consisting of a monofilament fiber, a tape fiber, a staple fiber, a melt spun non-woven fiber, a bicomponent/splittable fiber, and a slit film fiber.

3. The fiber in claim 2 wherein said fiber is present as a structure selected from the group consisting of a multifilament fiber, a monofilament fiber, a tape fiber, a staple fiber, a melt spun non-woven fiber, a bicomponent/splittable fiber, and a slit film fiber.

4. The fiber in claim 1 wherein said fiber is textured.

5. The fiber in claim 2 wherein said fiber is textured.

6. The fiber in claim 3 wherein said fiber is textured.

7. A multifilament yarn comprising at least one fiber as defined in claim 1.

8. A multifilament yarn comprising at least one fiber as defined in claim 2.

9. A multifilament yarn comprising at least one fiber as defined in claim 3.

10. A multifilament yarn comprising at least one fiber as defined in claim 4.

11. A multifilament yarn comprising at least one fiber as defined in claim 5.

12. A multifilament yarn comprising at least one fiber as defined in claim 6.

13. The fiber in claim 7 wherein said fiber is a bulk continuous filament.

14. The fiber in claim 8 wherein said fiber is a bulk continuous filament.

15. The fiber in claim 9 wherein said fiber is a bulk continuous filament.

16. The fiber in claim 10 wherein said fiber is a bulk continuous filament.

17. The fiber in claim 11 wherein said fiber is a bulk continuous filament.

18. The fiber in claim 12 wherein said fiber is a bulk continuous filament.

19. The fiber in claim 1 wherein said fiber comprises at least one pigment.

20. The fiber in claim 2 wherein said fiber comprises at least one pigment.

21. The fiber in claim 1 wherein said fiber comprises at least one ultraviolet absorber.

22. The fiber in claim 2 wherein said fiber comprises at least one ultraviolet absorber.

23. A fabric comprising at least one fiber as defined in claim 1.

24. A fabric comprising at least one fiber as defined in claim 2.

25. A fabric comprising at least one fiber as defined in claim 3.

26. A fabric comprising at least one fiber as defined in claim 4.

27. A fabric comprising at least one fiber as defined in claim 5.

28. A fabric comprising at least one fiber as defined in claim 6.

29. A fabric comprising at least one fiber as defined in claim 21.

30. A fabric comprising at least one multifilament yarn as defined in claim 7.

31. A fabric comprising at least one multifilament yarn as defined in claim 8.

32. A fabric comprising at least one multifilament yarn as defined in claim 9.

33. A fabric comprising at least one multifilament yarn as defined in claim 10.

34. A fabric comprising at least one multifilament yarn as defined in claim 11.

35. A fabric comprising at least one multifilament yarn as defined in claim 12.

36. A colored transparent polypropylene fiber comprising at least one nucleator compound and at least one liquid polymeric colorant defining a plurality of elongate colored rods within said fiber.

37. The fiber in claim 36 wherein said fiber is present as a structure selected from the group consisting of a monofilament fiber, a tape fiber, a staple fiber, a melt spun nonwoven fiber, a bicomponent/splittable fiber, and a slit film fiber.

38. The fiber in claim 37 wherein said fiber is present as a structure selected from the group consisting of a multifilament fiber, a monofilament fiber, a tape fiber, a staple fiber, a melt spun nonwoven fiber, a bicomponent/splittable fiber, and a slit film fiber.

39. The fiber in claim 38 wherein said fiber is textured.

40. A multifilament yarn comprising at least one fiber as defined in claim 36.

41. A multifilament yarn comprising at least one fiber as defined in claim 37.

42. A multifilament yarn comprising at least one fiber as defined in claim 38.

43. A multifilament yarn comprising at least one fiber as defined in claim 39.

44. A fabric comprising at least one fiber as defined in claim 36.

45. A fabric comprising at least one fiber as defined in claim 37.

46. A fabric comprising at least one fiber as defined in claim 38.

47. A fabric comprising at least one fiber as defined in claim 37.

48. A fabric comprising at least one multifilament yarn as defined in claim 40.

49. A fabric comprising at least one multifilament yarn as defined in claim 41.

50. A fabric comprising at least one multifilament yarn as defined in claim 42.

51. A fabric comprising at least one multifilament yarn as defined in claim 43.

* * * * *

UNITED STATES PATENT AND TRADEMARK OFFICE

CERTIFICATE OF CORRECTION

PATENT NO. : 6,849,330 B1
DATED : February 1, 2005
INVENTOR(S) : Brian Morin and Martin Cowan It is certified that error appears in the above-identified patent and that said Letters Patent is hereby corrected as shown below:

Column 24,
Line 16, after the word "claim" delete the number -- 37 -- and insert the number -- 39 --.

Signed and Sealed this

Twenty-third Day of August, 2005

JON W. DUDAS
*Director of the United States Patent and Trademark Office*